US005503767A

United States Patent [19]

Schwartz

[11] Patent Number: 5,503,767

[45] Date of Patent: Apr. 2, 1996

[54] ANTI-STATIC RINSE ADDED FABRIC SOFTENER

[75] Inventor: Curtis Schwartz, Ambler, Pa.

[73] Assignee: Rohm and Haas Company, Philadelphia, Pa.

[21] Appl. No.: 243,427

[22] Filed: May 16, 1994

Related U.S. Application Data

[60] Continuation of Ser. No. 95,238, Jul. 21, 1993, abandoned, which is a division of Ser. No. 794,535, Nov. 19, 1991, Pat. No. 5,254,268.

[51] Int. Cl.[6] ..... C11D 3/37; D06M 15/19

[52] U.S. Cl. ..... 252/174.23; 252/8.6; 252/174.21; 252/174.22; 252/174.24

[58] Field of Search ..... 252/8.6, 173, 174.21, 252/174.22, 174.23, 174.24

[56] References Cited

U.S. PATENT DOCUMENTS

| | | | |
|---|---|---|---|
| 4,326,965 | 2/1982 | Lips et al. | 252/8.6 |
| 4,797,223 | 1/1989 | Amick et al. | 252/174.23 |
| 4,908,140 | 3/1990 | Bausch et al. | 252/8.6 |
| 5,130,369 | 7/1992 | Hughes et al. | 524/846 |
| 5,318,719 | 6/1994 | Hughes et al. | 252/174 |

FOREIGN PATENT DOCUMENTS

| | | |
|---|---|---|
| 213500 | 8/1986 | European Pat. Off. . |
| 356210 | 8/1989 | European Pat. Off. . |
| 23585 | 5/1989 | Japan . |
| 1549189 | 7/1979 | United Kingdom . |
| 9012862 | 11/1990 | WIPO . |
| 9119778 | 12/1991 | WIPO . |

OTHER PUBLICATIONS

*Abstract* Database WPI, Week 8902, Derwent Publications Ltd., London, GB; AN 89–01377 & JP–A–63 291 999 (Lion Corp.) 29 Nov. 1988.

*Primary Examiner*—Ponnathapura Achutamurthy
*Attorney, Agent, or Firm*—James G. Vouros

[57] ABSTRACT

This invention relates to a rinse added fabric softening composition comprising from about 25 to about 95 percent by weight water, from about 2 to about 60 percent by weight of a cationic softening agent and from about 0.5 to about 18 percent by weight of a water-soluble polymer, wherein said polymer is a reaction product of (a), (b) and, optionally (c), wherein;

(a) is selected from the group consisting of ethylenically unsaturated monocarboxylic acids and their salts, ethylenically unsaturated dicarboxylic acids, their salts and anhydrides, (b) is selected from the group consisting of surfactant radicals and polyalkylenoxy compounds, wherein the surfactant radicals consist of a hydrophobic group linked to a polyalkylenoxy group and (c) is a carboxylate-free monomer.

16 Claims, No Drawings

ANTI-STATIC RINSE ADDED FABRIC SOFTENER

This application is a continuation of application Ser. No. 95,238 filed Jul. 21, 1993, abandoned, which is a division of application Ser. No. 794,535, filed Nov. 19, 1991, now U.S. Pat. No. 5,254,268.

FIELD OF THE INVENTION

This invention relates to a method of enhancing the anti-static properties of fabrics by treating them, during the laundering process, with compositions containing water-soluble polymer. More specifically, this invention relates to the addition of these polymers to fabric softener compositions used during the rinse cycle of the laundering process.

BACKGROUND OF THE INVENTION

Fabric softener compositions have been in commercial use for many years as treatments for laundered fabrics. Fabric softeners are generally employed as dryer-added sheets or as rinse-added fabric softeners. Fabric softeners impart favorable properties to the fabric such as enhanced softness, increased fluffiness, reduced levels of static electricity and easier ironing.

A modern laundering process utilizing an automatic washing machine typically washes laundry in four stages. During the first stage, a wash cycle, the laundry is agitated in water containing a detergent. Next, during a first spin cycle, wash liquor is removed and the laundry is spun to remove excess water. This cycle is followed by a rinse cycle where the washing machine tub is filled with clean water, a rinse-added fabric softener is optionally added, and the laundry is again agitated. A final spin cycle removes the rinse liquor and the laundry is again spun to remove excess water. Following the laundering process, the laundry is either hung until dry or placed in an automatic dryer, optionally adding a dryer-added fabric softener sheet to the dryer.

Rinse-added fabric softeners are generally dilute aqueous suspensions or dispersions of cationic softening agents such as quaternary ammonium compounds. Typically, the quaternary ammonium compounds are salts of the formula:

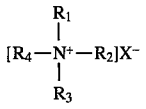

where $R_1$, $R_2$, $R_3$, and $R_4$ are lipophilic organic substituents and X is a halogen. The positively charged cation is readily adsorbed onto surfaces of fabric being laundered. This deposition of the cation onto the fabric imparts enhanced softness to the fabric and diminishes the static electricity built up on the fabric surface.

Dryer-added sheets also employ quaternary ammonium salts to enhance softness and reduce the level of static electricity. In manufacturing the sheets, the quaternary ammonium salts are sprayed or coated onto a non-woven fabric, or they are added directly to the formulation used to make the non-woven fabric.

Several attempts have been made to enhance the softness and anti-static properties of rinse-added fabric softener through the addition of polymeric compounds.

British Patent No. 1,549,180 to Dumbrell et al. teaches a composition useful for treating fabric in the final rinse of the laundering process. This composition contains a cationic quaternary ammonium compound with one or more long chain alkyl groups, and a silicone compound, such as a linear fluorinated polysiloxane. Through the use of this linear silicone compound, it is purported that in addition to fabric softening benefits, this compound also imparts the benefits of easier ironing, anti-static properties, and soil resistant properties.

U.S. Pat. No. 4,908,140 to Bausch et al. reports a similar composition as that reported in Dumbrell et al. However, Bausch et al. found that through the use of an aqueous emulsion of a highly branched or crosslinked silicone polymer, as compared to the linear compounds of Dumbrell et al., the rewettability of fabrics was enhanced in addition to the softness.

U.S. Pat. No. 4,326,965 discloses a liquid fabric softening composition containing a cationic fabric softening agent and a polymeric additive such as polyethylene glycol with a molecular weight of 6,000. By the inclusion of polyethylene glycol, fabric softening compositions are prepared that are water-dispersable and pourable and can be more easily dispensed by an automatic dosing device into the rinse cycle on an automatic washing machine. No change in softening properties was reported.

Japanese Patent Application J 89-023585-B addresses the problem of inferior softening and anti-static performance of fabric softeners on synthetic fibers as compared to cotton fibers. By using a softening composition containing cationic surfactant, such as a quaternary ammonium salt, and a carboxylic acid type anionic compound, the deposition of the quaternary ammonium salt onto synthetic fibers is increased. This softening composition containing the carboxylic acid type anionic compound is reported to lead to equivalent softening and antistatic properties on synthetic fibers as prior known compositions led to with cotton fibers. No improvement was reported for cotton fabrics. In addition, unlike the polymers used in the compositions of the present invention, many of the polymers used in Japanese Patent Application J 89-023585-B are not compatible with rinse-added fabric softener compositions.

SUMMARY OF THE INVENTION

This invention relates to a method of enhancing the anti-static properties of all types of fabrics by treating them, during the laundering process, with compositions containing water-soluble polymers. More specifically, this invention relates to the addition of water-soluble polymers to fabric softener compositions used during the rinse cycle of the laundering process. Furthermore, when added in effective amounts, the water-soluble polymers are compatible with rinse-added fabric softener compositions.

DETAILED DESCRIPTION OF THE INVENTION

The present invention is concerned with an improved rinse-added fabric softener composition. The rinse-added fabric softener composition of the present invention contains a water-soluble polymer found to be useful in improving the anti-static properties. The polymers found to be useful in the composition of the present invention include, for example, the polymers disclosed in U.S. Pat. No. 4,797,223 ('223), commonly assigned to the same assignee of the present invention and hereby incorporated by reference. In addition, it has also been discovered that the polymers of the '223 patent can be further modified and be effective in the compositions of the present invention. Another group of polymers effective in the composition of the present invention include certain graft copolymers.

The first group of water-soluble polymers useful in the composition of the present invention include two broad structural classes. The polymers in these two classes share several important characteristics. First, polymers in both classes are prepared from at least one monomer selected from ethylenically unsaturated $C_3$–$C_6$ monocarboxylic acids and their salts, and ethylenically unsaturated dicarboxylic acid, their salts, and their anhydrides. Examples of the monocarboxylic acids include acrylic acid and sodium acrylate, and examples of the ethylenically unsaturated dicarboxylic acid include maleic acid, maleic anhydride, itaconic acid, mesaconic acid, fumaric acid and citraconic acid. Second, the polymers of this first group include either; a "surfactant" radical containing a hydrophobic group, for example a ($C_1$–$C_{18}$) hydrocarbyl group, linked to a polyalkylenoxy group; or a polyalkylenoxy group.

Depending on the preparative process employed, the surfactant radical can optionally contain a portion of a polymerizable ethylenically unsaturated "surfactant monomer" which is copolymerized with the acid, the anhydride and/or acid salt comonomer, or the radical can comprise a portion of an alcohol used to esterify or transesterify a polymer including carboxylic acid and/or carboxylic acid ester radicals. As a third alternative, the radical can comprise a portion of a mercaptan-functional chain transfer agent used in polymerizing monomer including ethylenically unsaturated carboxylic acid, anhydride and/or salts of such monomer.

In addition to residues of polymerizable ethylenically unsaturated monocarboxylic acids, dicarboxylic acids, surfactant radicals and polyalkylenoxy groups, the water-soluble polymers of this first group can optionally include residues of "carboxylate-free" monomers. By "carboxylate-free" monomer it is meant an ethylenically unsaturated copolymerizable monomer not having pendent carboxylic acid and/or carboxylate salt functionality. An example of a carboxylate-free monomer is ethyl acrylate. Typically, the carboxylate-free monomer is copolymerized with the monocarboxylic acid and/or the dicarboxylic acid monomer. A "carboxylate-free" monomer can include a surfactant radical, such as in the case of an allyl ether-functional surfactant monomer.

The water-soluble polymers in the first structural class of this first group of polymers share a common structural feature. The surfactant radical, the polyalkylenoxy group, or a combination thereof, can be positioned at any site along the "backbone" of the polymer chain, the "backbone" being viewed as made up of a sequence of alkylene groups which can have pendent carbonyl radicals. The surfactant radicals or the polyalkylenoxy groups are thus covalently linked to one or more sites along the polymer chain.

The water-soluble polymers of the second structural class of the polymers in the first group have the surfactant radical, or the polyalkylenoxy group, or a combination thereof, at one terminus of the polymer chain. For example, when the surfactant radical is used, polymers in this structural class are typically prepared by including a chain transfer agent bearing the surfactant radical in the polymerization reaction mixture. The polymerization of individual polymer molecules is terminated by the chain transfer agent. The chain transfer process results in the surfactant radical being covalently linked to the terminus of the polymer chain.

The polymers in this first group that are useful in the composition of the present invention are prepared according to the methods described in the '223 patent and in U.S. Pat. No. 5,130,369, commonly assigned to the same assignee of the present invention and herein incorporated by reference.

Another group of polymers useful in the composition of the present invention are graft copolymers formed from polymerized units of i) alkylene oxides, alkoxylates and combinations thereof, ii) ethylenically unsaturated carboxylic acid monomers and, optionally, iii) carboxylate-free monomers. Examples of (i), the alkylene oxides and alkoxylates include polymers based on ethylene oxide, propylene oxide, butylene oxide and combinations thereof. Examples of the ethylenically unsaturated carboxylic acid monomers include acrylic acid, methacrylic acid, maleic acid, itaconic acid, crotonic acid, vinylacetic acid, acryloxypropionic acid and combinations thereof. The carboxylate-free monomer includes any monomer copolymerizable with (i) and (ii).

These graft polymers differ from the polymers of the first group described above in that these polymers are formed by the grafting of carboxylic acid monomers, or polymers formed from carboxylic acid monomers and/or carboxylate-free monomers, onto a polyalkylene oxide substrate by way of abstracting a hydrogen from the polyalkylene oxide substrate. These graft polymers can be formed by way of either an aqueous polymerization process utilizing water-soluble, free-radical forming initiators and a metal salt, as described in U.S. Pat. No. 5,318,719, filed on Nov. 22, 1989, commonly assigned to the same assignee of the present invention and herein incorporated by reference, or by a nonaqueous graft polymerization process.

The polymers useful in the compositions of the present invention must be compatible with rinse-added fabric softener compositions when added in effective amounts. It has been found that it is preferable to polymerize the polymers used in the composition of the present invention in a nonaqueous solvent or even more preferably to perform the polymerizations without any solvent present at all. Even though the polymers prepared in an aqueous solution polymerization are suitable for use in the composition of the present invention, it is believed the aqueous systems lead to a higher amount of residual homopolymer. It is further believed that it is these homopolymers that lead to poor compatibility with rinse-added fabric softening composition.

The polymer should be added to the rinse-added fabric softener such that it is present in the fabric softening composition at a concentration of from about 0.5 to 18 percent by weight, more preferably from about 0.5 to 3.5 percent by weight, and even more preferably from about 0.5 to 2 percent by weight based on the total weight of the composition. The fabric softening composition of the present invention may also be in concentrate form, whereby it is preferable for the polymer level to be from about 2 to about 18 percent by weight based on the total weight of the composition. It is also preferable to neutralize the polymer, for example with sodium hydroxide, before mixing the polymer with the fabric softening composition. In addition, the composition contains from about 25 to 95 percent water by weight based on the total weight of the composition and from about 2 to 60 percent by weight of a cationic softening agent. The fabric softening compositions of the present invention can be used in either the home laundering process or the industrial laundering process and therefore the composition may depend on the specific use.

Besides the polymer, water and cationic softening agents, the composition may further contain other normal adjuvants well known to those skilled in the art. For example, viscosity modifiers, germicides, fluorescers, perfumes including deodorizing perfumes, organic or inorganic acids, soil resistant agents, colorants, anti-oxidants, anti-yellowing agents and ironing aids. These additives can be incorporated into the composition either alone or in suitable carriers. Besides water, the composition may also include other solvents such as a lower alkanol, a glycol, a glycolether and the like.

In addition, the fabric softening compositions of the present invention can be prepared as either a ready-to-use composition or as a concentrate. If it is in the concentrate form, it can be diluted with an appropriate solvent, for example water, before use.

The invention will now be illustrated by the following non-limiting examples. In the following examples, percentage composition is by weight.

Examples 1 and 2 Polymer Preparation

EXAMPLE 1

To a two liter, 4 neck flask equipped with a mechanical stirrer, reflux condenser, and inlets for the gradual addition of monomer, was added 225 grams of polyethylene glycol 1000 (PEG, molecular weight 1000). The PEG was heated to 150° C. and then 75 grams of glacial acrylic acid and 3.75 grams di-t-butyl peroxide were added over a period of one hour. Once the addition was completed, the contents of the reaction flask were held at 150° C. for an additional 30 minutes and then allowed to cool to ambient temperature.

EXAMPLE 2

The same procedure as example 1 was followed except 260 grams of polyethylene glycol 8000 (PEG, molecular weight 8,000), 140 grams glacial acrylic acid, and 14 grams di-t-butylperoxide were used in the preparation of the sample.

Test Procedures

Compatibility

Several different types of polymers were added at a 2% active polymer concentration to Snuggle® (a trademark of Lever Brothers) fabric softener, Downy® (a trademark of the Procter & Gamble Co.) fabric softener and a fabric softener formulation made in our laboratory. The composition was stirred for one hour. If a precipitate was observed in any of the compositions, the polymer was classified as incompatible. Test results are shown in Table I.

TABLE I

| Compatibility Data[1] | |
|---|---|
| Incompatible Polymers | Compatible Polymers |
| polyacrylic acid | AA/(12 EO/12–15 C)[2] |
| 70 AA/30 maleic anhydride | AA/(10 EO/16 C) |
| 77 AA/23 AMPS | AA/(40 EO/16 C) |
| 70 AA/30 MA | AA/PEG-Example 1 |
| AA/PEG grafts (aqueous)[3] | (non-aqueous)[3] |
| 29% PEG 8000 | |
| 29% PEG 1000 | |
| 29% PEG 3400 | |
| 44% PEG 3400 | |
| AA/(12 EO/12–15 C)[2] (aqueous)[3] | |

[1]AA = acrylic acid, AMPS = 2-acrylamido-2-methylpropanesulfonic acid, MA = methacrylic acid, PEG = polyethylene glycol
The (EO/C) designation indicates the number of carbon atoms in alkyl group and degree of ethylene oxide polymerization in the alcohol ethoxylate.

TABLE I-continued

| Compatibility Data[1] | |
|---|---|
| Incompatible Polymers | Compatible Polymers |

[2]The alcohol ethoxylate used to prepare these polymers was Neodol® (trademark of Shell Chemical Company) 25-12 surfactant.
[3]The designation aqueous and nonaqueous indicate the method used to prepare the polymers.

Anti-Static Test Procedure-Domestic

Test cloths were purchased from Testfabrics, Inc. Middlesex, N.J. The size of each test cloth was twelve square inches and the cloths were composed of the following types of fabrics; 100 percent nylon; 100 percent cotton; 100 percent acrylic; 100 percent polyester; and 65 percent polyester/35 percent cotton (poly/cotton). In addition, 100 percent cotton bed-sheets were used during the laundering process to provide ballast to the machine's load.

Kenmore® heavy duty automatic washers, 80 series, were used for cloth washing and treating. Water fill levels were set on high, corresponding to approximately 84 liters of water, and the water temperature settings were warm for the wash cycle and cold for the rinse cycle. These temperature settings corresponded to about 100° F. wash cycle and 70° F. rinse temperatures. After the wash cycle, the cloths were dried in an electric dryer.

A Keithly model 610C Electrometer equipped with a model 2501 static probe was used to measure static charge on the fabric.

Initially, the experimental cloths and the cotton bedsheets were machine-washed with Tide® (a trademark of Procter & Gamble Co.)laundry detergent granules and rinsed until the cloths were free from any foam. This step was used to remove any non-permanent coatings present on the fabric as a result of the manufacturing process. Then, in the actual testing of the various rinse-added fabric softeners of the present invention, the experimental cloths were added to the machine, along with the cotton sheets, and the machine was run through a regular wash cycle. In the wash cycle, when the water level was reached, ½ dose of heavy duty laundry detergent was added, either Tide® liquid laundry detergent or Wisk® (a trademark of Lever Brothers) laundry detergent. At the start of the rinse cycle, when the desired water level was reached and agitation started, the rinse-added fabric softener was added. Unless otherwise indicated in the Tables, the dose of fabric softener added was one capful, equal to 90 ml.

Once the cleaning, rinse and spin cycles were completed, the fabrics were placed in the dryer for one to two hours, removed from the dryer and then passed under the static probe to measure the values recorded in volts.

The polymers useful in this invention were added to various commercially available rinse-added fabric softeners. They were added at the percentages shown in the tables. Specifically used were Snuggle® fabric softener and Downy® fabric softener.

Table II–VI show the results of testing with no additives, with commercially available rinse-added fabric softener and with commercially available rinse-added fabric softeners and polymer. The polymers shown in Table I and II (polymer A and B) are compositionally the same. The difference is that polymer B was added as a 70 percent by weight solution of polymer in propylene glycol. Table III contains comparative data showing the absence of any anti-static effect due to the propylene glycol. With all of the types of fabrics tested, including cotton (see Table IV), the added polymer improves the anti-static properties of the fabric.

Tables VII and VIII show the anti-static properties with no additives, with added cationic softening agents and with cationic softening agent and added copolymer of Example 1. Again, the anti-static properties of the fabrics tested were improved when the polymer was added to the rinse treatment. These results can be compared to the results in Table IX where only polyethylene glycol was added and only limited effectiveness on certain fabrics was achieved.

Anti-Static Test Procedure-Industrial

Nylon, polyester/cotton, polyester test fabrics, and cotton ballast (3 pounds) were washed in an Eumenia model EU-340 European Style mini-washer. The laundering cycle and wash/rinse formula was adjusted to simulate industrial and institutional conditions. This consisted of a 15 minute wash (soft water, 90° C., 400 ppm Triton® (trademark of the Union Carbide Company) N-101 surfactant, 2500 ppm NaOH, and 0.5 grams used cooking oil as background soil) followed by three sequential 2 minute rinses. The final rinse pH was adjusted to 5–7 with 25% $H_2SO_4$, followed by the addition of the softener/anti-static agent to bring the concentration of actives in the wash bath to the levels indicated in Table X. The final rinse lasted 10 minutes. Measurement of static charge is the same as described for domestic laundry testing. The anti-static test results for the industrial testing can be seen in Table X.

The standard deviation of all the voltage measurements given in the following tables varies, but is approximately 20% of the measured value.

TABLE II

Anti-Static Properties of Rinse Added Fabric Softener and Polymer B

| Rinse Treatment | VOLTS ACRYLIC | NYLON | POLY/COTTON |
|---|---|---|---|
| None | 18,000 | 13,000 | 4,500 |
| Snuggle ® | 6,000 | 9,000 | 2,000 |
| Snuggle ® + 0.5% Polymer B* | 3,000 | 6,300 | 3,000 |
| Snuggle ® + 1.5% Polymer B | 100 | 100 | 500 |
| Snuggle ® + 2.5% Polymer B | 10 | 100 | 500 |

*30% AA/70% (12 EO/12–15 C), DP = 20. The alcohol ethoxylate used to prepare this polymer was Neodol ® (trademark of Shell Chemical Company) 25-12. Polymer B was added as a 70% by weight solution of polymer in propylene glycol.

TABLE III

Anti-Static Properties of Rinse Added Fabric Softener and Polymer

| Rinse Treatment | VOLTS Acrylic | Nylon | Poly/Cotton |
|---|---|---|---|
| None | 22,300 | 16,700 | 3,700 |
| Snuggle ® | 5,300 | 3,700 | 2,300 |
| Snuggle ® + 2% Polymer A[1] | 500 | 600 | 1,200 |
| Snuggle ® + 2% Polymer B[2] | 800 | 1,200 | 600 |
| Snuggle ® + 1% propylene glycol | 8,000 | 6,000 | 900 |

[1]30% AA/70% (12 EO/12–15 C), DP = 20. The alcohol ethoxylate used to prepare this polymer was Neodol ® 25-12.
[2]Polymer B is the same as Polymer A except Polymer B was used as a 70% by weight solution of polymer in propylene glycol.

TABLE IV

Anti-Static Properties of Rinse Added Fabric Softener and Polymer

| Rinse Treatment | VOLTS Acrylic | Nylon | Poly/Cotton | Cotton |
|---|---|---|---|---|
| None | 20,300 | 17,800 | 11,800 | 3,000 |
| Snuggle ® | 10,500 | 3,100 | 2,000 | 3,400 |
| Snuggle ® + Polymer E[1] | 300 | 200 | 400 | 200 |
| Snuggle ® + Polymer F[2] | 4,100 | 1,900 | 2,400 | 800 |
| Snuggle ® + Polymer G[3] | 1,300 | 1,200 | 1,100 | 1,600 |

[1]AA/(40 EO/16 C), DP = 20, 2 (40 EO/16 C) units per AA chain
[2]AA/(10 EO/16 C), DP = 10, 4 (10 EO/16 C) units per AA chain
[3]AA/(40 EO/16 C), DP = 20, 4 (40 EO/16 C) units per AA chain

TABLE V

Anti-Static Properties of Polymer in Rinse Added Fabric Softeners

| Rinse Treatment[1] | VOLTS Acrylic | Nylon | Poly/Cotton |
|---|---|---|---|
| None | 19,000 | 13000 | 6000 |
| Snuggle ® | 7500 | 9000 | 4300 |
| Snuggle ® + Polymer D[2] | 2900 | 5000 | 6000 |
| Snuggle ® + Polymer C[3] | 1200 | 2400 | 1600 |

[1]Amount of polymer added to the Snuggle ® was 2.5%.
[2]Polymer D = AA/(40 EO/1 C), DP = 10, 4 (40 EO/1 C) units per AA chain.
[3]Polymer C = AA/(10 EO/1 C), DP = 10, 4 (10 EO/1 C) units per AA chain.

TABLE VI

Anti-Static Properties of Rinse Added Fabric Softener and Polymer

| RINSE TREATMENT | VOLTS ACRYLIC | NYLON | POLY-ESTER |
|---|---|---|---|
| None | 21,000 | 12,000 | 28,000 |
| Downy ® | 6,300 | 4,800 | 7,000 |
| Downy ® + 1% Polymer A | 2,700 | 4,000 | 5,200 |
| Downy ® + 1.5% Polymer A | 500 | 1,000 | 1,300 |
| Downy ® + 2.5% Polymer A | 300 | 300 | 1,000 |
| Downy ® @1.5X Dose | 500 | 5,000 | 4,000 |
| Bounce ® (1 sheet) in full size dryer* | <10 | <10 | <10 |

*Bounce ® fabric softener is a product of Procter and Gamble Company.

TABLE VII

Anti-Static Properties of Quaternary Salt and Polymer

| RINSE TREATMENT | VOLTS ACRYLIC | NYLON | POLY/COTTON |
|---|---|---|---|
| None | 17,000 | 13,000 | 2,800 |
| 5% Quat[1] | 8,300 | 7,500 | 2,000 |
| 4% Quat, 1% Polymer H[2] | 5,500 | 6,900 | 2,800 |
| 3.5% Quat, 1.5% Polymer H | 2,500 | 1,600 | 2,100 |

TABLE VII-continued

Anti-Static Properties of Quaternary Salt and Polymer

| RINSE TREATMENT | VOLTS ACRYLIC | NYLON | POLY/COTTON |
|---|---|---|---|
| 2.5% Quat, 2.5% Polymer H | 1,900 | 1,700 | 2,000 |
| 1% Quat, 4% Polymer H | 4,600 | 5,100 | 1,000 |
| 5% Polymer H | 22,000 | 15,000 | 5,500 |

[1]Quat used was Arosurf ™ (a trademark of the Sherex Chemical Company) TA 101. The remainder of the composition was water and 0.5% NaCl.
[2]Polymer H is the polymer of Example 1.

TABLE VIII

Anti-Static Properties of Quaternary Salt and Polymer

| RINSE TREATMENT | VOLTS NYLON | POLYESTER | POLY/COTTON |
|---|---|---|---|
| None | 15,300 | 28,700 | 12,700 |
| 5% Quat* | 5,700 | 5,000 | 3,700 |
| 4% Quat and 1% Polymer H | 4,700 | 5,700 | 4,300 |
| 3.5% Quat and 1.5% Polymer H | 1,300 | 1,700 | 500 |
| 2.5% Quat and 2.5% Polymer H | 1,000 | 2,400 | 1,300 |
| 1% Quat and 4% Polymer H | 12,700 | 21,000 | 8,700 |
| 5% Polymer H | 16,000 | 25,000 | 12,000 |

*Quat used was Adogen ™ (a trademark of the Sherex Chemical Company) 442. The remainder of the composition was water and 0.5% NaCl.

TABLE IX

Anti-Static Properties of Polyethylene Glycol (Comparative)

| Rinse Treatment | VOLTS Acrylic | Nylon | Poly/Cotton | Cotton |
|---|---|---|---|---|
| None | 10,500 | 9,800 | 4,700 | 2,300 |
| Snuggle ® | 13,000 | 3,300 | 2,300 | 10,000 |
| Snuggle ® + PEG 550[1] | 13,200 | 4,200 | 1,700 | 3,200 |
| Snuggle ® + PEG 1000[1] | 14,700 | 7,800 | 3,000 | 2,800 |
| Snuggle ® + PEG 20,000[1] | 9,200 | 2,100 | 2,900 | 4,100 |

[1]PEG 550 = polyethylene glycol, Molecular weight = 550
PEG 1000 = polyethylene glycol, Molecular weight = 1000
PEG 20,000 = polyethylene glycol, Molecular weight = 20,000
PEG added to the Snuggle ® fabric softener at 2.5%.

TABLE X

Anti-Static Properties of Polymers Under Industrial and Institutional Laundering Conditions

| Rinse Treatment | VOLTS Nylon | Poly/Cotton | Polyester |
|---|---|---|---|
| 15 ppm Quat[1] | 16,000 | 13,000 | 15,000 |
| 15 ppm Quat and 15 ppm Polymer I | 4,000 | 2,700 | 7,000 |

[1]The quaternary ammonium salt used was Varisoft ™ (a trademark of the Sherex Chemical Company) 475.
[2]Polymer I is the polymer of Example 2.

I claim:

1. A fabric softening composition comprising from about 25 to about 95 percent by weight water, from about 2 to about 60 percent by weight of a cationic softening agent and from about 0.5 to about 18 percent by weight of a water-soluble polymer, wherein said polymer is a reaction product of (a), (b) and, optionally (c), wherein;

(a) is selected from the group consisting of ethylenically unsaturated monocarboxylic acids and their salts, and ethylenically unsaturated dicarboxylic acids, their salts and anhydrides, (b) is selected from the group consisting of surfactant radicals and polyalkylenoxy compounds, wherein the surfactant radicals consist of a hydrophobic group linked to a polyalkylenoxy group and (c) is a carboxylate-free monomer, and wherein the fabric softening composition dose not contain a surfactant.

2. The fabric softening composition of claim 1 wherein the water-soluble polymer is selected form the group consisting of;

(a) polymers having the formula

A(B)m(C)n(D)oE, (1) A being a group selected from $R^b—C(O)—R^a—$, $R^c—C(O)NH—R^d—$ and $R^b—C(O)—R^a—C(O)—R^b—$;

$R^a$ being selected from $(C_2–C_5)$alkylidene and $(C_2–C_3)$alkylidene derivatives including a chain initiator or chain transfer radical;

$R^b$ being selected from —OQ and $R^c$;

$R^c$ having the formula $R^1Z(X^1)a(X^2)b—$;

$R^1$ being selected from hydrogen, $(C_1–C_{18})$alkyl, $(C_1–C_{18})$alkaryl and $(C_1–C_{18})$aralkyl;

Z being selected from —O—, —S—, $—CO_2—$, $—CONR^2$, and $—NR^2$;

$X^1$ being $—CH_2CH_2O—$;

$X^2$ being $—C(CH_3)HCH_2O—$;

a being a positive integer and being a non-negative integer, the sum of a and b being from 3 to about 200, wherein the $X^1$ and $X^2$ units are arranged in any sequence;

$R^2$ being selected from H, $(C_1–C_4)$alkyl, and $H(X^1)_d(X^2)_e—$;

d and e being non-negative integers, the sum of d and e being from 1 to about 100;

Q being selected from H and the positive ions forming soluble salts with carboxylate anions;

$R^d$ being a group which includes a carbon-carbon single bond formed during polymerization of the polymer from a polymerizable carbon-carbon double bond;

(2) B being a group selected from $—R^e—\overset{|}{C}(O)—OQ$ and $—R^e\{\overset{|}{C}(O)OQ\}—R^e—\{C(O)—OQ\}$, $R^e$ being a saturated trivalent aliphatic group having from two to five carbon atoms (3) C being selected from $$-\overset{|}{R^e}-R^c,\ -\overset{|}{R^f}-NHC(O)-R^c,\ -\overset{|}{R^e}-C(O)-R^c \text{ and}$$

$$-\overset{|}{R^e}\{C(O)R^b\}-R^e-\{C(O)-R^b\},$$

$R^f$ being a group which included a carbon-carbon single bond formed during polymerization of the polymer from a polymerizable carbon-carbon double bond;

(4) D having the formula $$-\overset{|}{R^e}-G$$

wherein G is an organic group excluding $R^c$ and $-CO_2Q$;

(5) E being a group selected from $$R^c-R^g-,\ R^b-C(O)-R^g-,\ R^c-C(O)NH-R^d-, \text{ and } R^b-C(O)-R^a-C(O)-R^g-,$$

$R^g$ being selected from $(C_2-C_5)$alkylene and $(C_2-C_5)$alkylene derivatives including a chain transfer radical;

m being a positive integer and n and o being non-negative integers, m being selected such that $(B)_m$ comprises from about 20 to 95 percent by weight of the polymer, n being selected such that $R^c$ comprises from about 80 to 5 percent by weight of the polymer, o being selected such that $(D)_o$ comprises from zero up to about 30 percent by weight of the polymer, the sum of the weight percentages of A, $(B)_m$, $(C)_n$, $(D)_o$ and E being 100 percent, it being further understood that the B, C, and D groups can be arranged in any sequence;

and the polymer having a number-average molecular weight from about 500 to 50,000; and (b) polymers having the formula L—J, L— having the formula $R^c-C(O)(CHR^3)_c-S-$, —J having the formula $-(B)_m(D)_oE$, the subscript c being selected from 1, 2, and 3, $R^3$ being selected from H—, $CH_3$—, and $C_2H_5$—, the weight ratio of L to J being from about 1:340 to 7:1, o being selected such that $(D)_o$ comprises up to about 40 percent by weight of the polymer, and the sum of m and n being from about 10 to 500.

3. The fabric softening composition of claim 2 wherein (1) A is selected from $$CH_3-\overset{|}{CH}-C(O)-OQ \text{ and } CH_3-\overset{|}{C}(CH_3)-C(O)-R^c;$$

(2) B is a group having the formula $$-CH_2\overset{|}{CH}-C(O)OQ;$$

(3) C is a group having the formula $$-\overset{|}{CH_2C}(CH_3)-C(O)-R^c; \text{ and}$$

(4) E is selected from $$-CH_2-CH_2-C(O)-OQ \text{ and } -CH_2-CHCH_3-C(O)-R^c.$$

4. The fabric softening composition of claim 3 wherein the polymer includes $R^c$ groups having the formula $R^1O(X^1)_a$— wherein $R^1$ is selected from hydrogen and $(C_1-C_{18})$alkyl, and a is from about 5 to 45.

5. The fabric softening composition of claim 4 wherein $R^1$ is $(C_{10}-C_{18})$alkyl.

6. The fabric softening composition of claim 5 wherein the number average molecular weight of the polymer is from about 1000 to 5000.

7. The fabric softening composition of claim 2 wherein the water-soluble polymer has the formula L—J, the sum of m and o being from about 20 to 150.

8. The fabric softening composition of claim 2 wherein the water-soluble polymer is selected from polymers having the formula L—J, the weight ratio of L to J being from about 1:100 to 2:1.

9. The fabric softening composition of claim 2 wherein G is selected from $-NH_2$, $-NHR^3$, $-OR^3$, $-OR^4-OH$, $-OR^4NH$, $-OR^4-SO_3Q$, $OR^4-PO_3Q$, $R^3$ being $(C_1-C_8)$alkyl, and $R^4$ being $(C_1-C_8)$alkylene.

10. The fabric softening composition of claim 2 wherein $R^d$ is alpha,alpha-dimethyl-meta-isopropenylbenzyl.

11. The fabric softening composition of claim 2 wherein the number average molecular weight of the polymer is from about 1,000 to 15,000.

12. A fabric softening composition comprising from about 25 to about 95 percent by weight water, from about 2 to about 60 percent by weight of a cationic softening agent and from about 0.5 to about 18 percent by weight of a water-soluble copolymer, wherein said copolymer is formed from a grafting reaction between i) polyalkylene oxides, polyalkoxylates and combinations thereof, ii) ethylenically unsaturated carboxylic acid monomers, polymers formed from polymerized units of ethylenically unsaturated carboxylic acid monomers, and optionally, iii) carboxylate-free monomers and wherein the fabric softening composition does not contain a surfactant.

13. The fabric softening composition of claim 12 wherein the ethylenically unsaturated carboxylic acid monomers are selected from the group consisting of acrylic acid, methacrylic acid, maleic acid, itaconic acid, crotonic acid, vinyl acetic acid, acryloxy, propionic acid and combinations thereof.

14. The fabric softening composition of claim 12 wherein the ethylenically unsaturated carboxylic acid monomer used to form the copolymer is acrylic acid.

15. The fabric softening composition of claim 12 wherein the polyalkylene oxides used to form the copolymer are selected from the group consisting of polymers based on ethylene oxide, propylene oxide, butylene oxide and combinations thereof.

16. The fabric softening composition of claim 12 wherein the polyalkylene oxide is polyethylene oxide.

* * * * *